United States Patent [19]

Exner

[11] 4,286,453

[45] Sep. 1, 1981

[54] DEVICE FOR SECURING THE DUMMY BLOCK ON THE PRESS STEM OF METAL-EXTRUSION PRESSES

[75] Inventor: Klaus Exner, Dusseldorf, Fed. Rep. of Germany

[73] Assignee: Schloemann-Siemag Aktiengesellschaft, Dusseldorf, Fed. Rep. of Germany

[21] Appl. No.: 39,664

[22] Filed: May 16, 1979

[30] Foreign Application Priority Data

May 20, 1978 [DE] Fed. Rep. of Germany ... 7815260[U]

[51] Int. Cl.[3] ..... B21C 25/00

[52] U.S. Cl. ..... 72/273

[58] Field of Search ..... 72/253, 270, 273

[56] References Cited

U.S. PATENT DOCUMENTS

| | | | |
|---|---|---|---|
| 3,282,074 | 11/1966 | Gardner | 72/273 |
| 3,282,075 | 11/1966 | Zhookoff | 72/273 |
| 3,369,384 | 2/1968 | Beneke et al. | 72/273 |

FOREIGN PATENT DOCUMENTS

| | | | |
|---|---|---|---|
| 1602303 | 7/1972 | Fed. Rep. of Germany | 72/270 |
| 2522694 | 12/1976 | Fed. Rep. of Germany | 72/270 |

*Primary Examiner*—Lowell A. Larson

*Attorney, Agent, or Firm*—Holman & Stern

[57] ABSTRACT

The press stem of an extrusion press has a bolt or peg received in a central bore. The bolt locates in a recess in a dummy block, to hold the dummy block to the end of the stem. If the dummy block and stem are not correctly aligned, the bolt can be pushed back into the bore against the resistance of spring. The spring pushes the bolt out again either when the dummy block is removed, or when it is correctly aligned.

3 Claims, 1 Drawing Figure

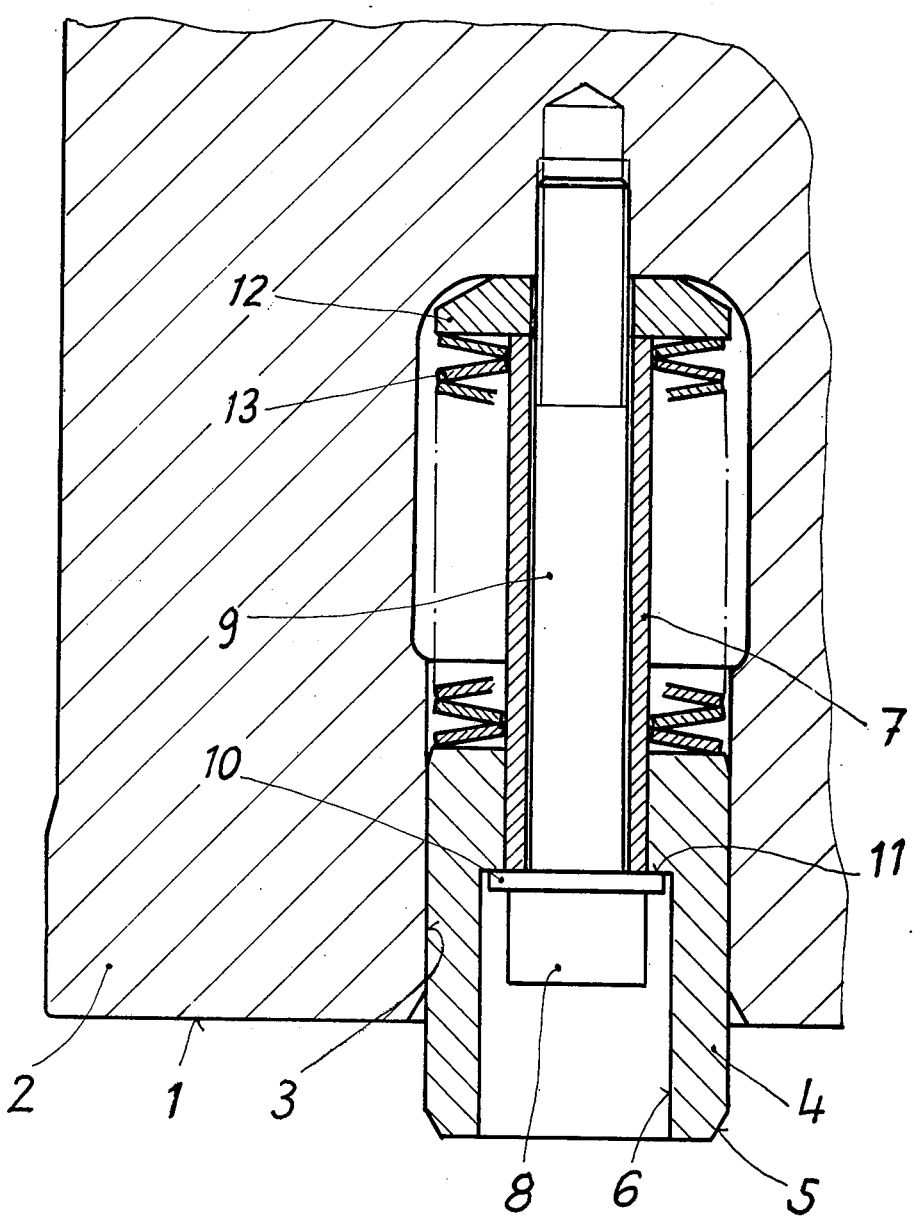
12
13
9
10
7
11
2
1
3
4
8
6
5

DEVICE FOR SECURING THE DUMMY BLOCK ON THE PRESS STEM OF METAL-EXTRUSION PRESSES

BRIEF SUMMARY OF THE INVENTION

The invention relates to a device for securing a dummy block on the press stem of a metal-extrusion press. The invention also relates to a press stem with such a device, and to a metal extrusion press.

The purpose of such a device is to support the dummy block in horizontal extrusion presses during the insertion of the billet into the billet container of a metal-extrusion press when the billet loader unit is no longer available as support means.

A construction is known in practice, in which a bolt is seated into the dummy block with a tight fit or a press fit. To achieve this, the bolt must be brought to very low temperatures, e.g. to minus 40° C., in order to be able to introduce it into the bore of the dummy block. This force fit is necessary, since otherwise there is a danger that during the heating-up of the block in the course of the extrusion process the fixed contact between the bolt and the block will be lost. If now such a bolt, owing perhaps to an incorrectly aligned dummy block is pressed into the press stem during operation, it cannot be extracted without difficulty. Although this bolt has a throughgoing threaded bore, so that by connecting a hydraulic line thereto the bolt can be expelled from the dummy block under a hydraulic pressure of about 200 to 400 bar, this would mean a down-time of several hours. Further difficulties arise if the front face of the press stem is upset.

According to the invention, there is provided a device for securing a dummy block on the press stem of a metal extrusion press, the device comprising a bolt, means for retaining the bolt in a bore on the end face of the press stem in such a way that the bolt projects from the end face, and means for resiliently urging the bolt out of the bore, such resilient urging means permitting the bolt to be pushed back into the bore.

With such a device, the bolt can easily be pressed into the front face of the press stem, should the dummy block not be precisely centered. Due to the axial resilience, with the bolt being arrested in the operating position against further outward axial movement, great operational reliability is obtained, because the bolt is always returned to the operating position.

The invention also provides a press stem for a metal extrusion press, the stem having a central bore in its end face, a bolt slidable in said bore and resiliently urged out of said bore, and means retaining the bolt in the bore so that it projects from the end face of the stem.

The bolt preferably itself contains a counterbored bore, in which the head of a threaded bolt is arranged and the threaded bolt, through a surrounding space bushing, is made fast in the bore of the press stem whilst between the rear side of the bolt and the bore end in the press stem a compression spring is provided. This compression spring is advantageously a set of cup springs.

Since the spacer is in compression and the threaded bolt is in tension, the head of the threaded bolt, which secures the bolt against further outward movement under the pressure of the spring, is positionally fixed. The compression spring seated between the rear side of the bolt and the end of the bore in the die, secures at all times the operating position of the bolt for accomodating the dummy block owing to the sliding contact between bolt and press stem.

BRIEF DESCRIPTION OF THE DRAWING

The invention will be further described, by way of example, with reference to the accompanying drawing which shows a section through the end of a press stem incorporating a device according to the invention.

On the end face 1 of a press stem 2 of a not illustrated metal-extrusion press, a central bore 3 is provided. In this bore 3 is seated slidably a bolt 4, which in the operating position projects by a certain amount out of the end face 1 of the press stem 2. On its front edge the bolt 4 has a chamfer 5 for easier insertion into the bore of a not illustrated dummy block. The bolt 4 has a stepped or counterbored axial bore 6, which has a greater diameter in the outward direction than in the inward direction. In the smaller bore 6 a spacer housing 7 is arranged flush with the boundary between the greater and the smaller bore 6. The larger bore 6 contains the head 8 of a threaded bolt 9 with a washer 10 on the front face of the spacer bushing 7 and the annular surface 11 of the stepped bore 6. The head 8 is behind the end face 1 of the press stem.

The threaded bolt 9 is screwed into the end of the bore 3 of the press stem 2, the spacer bushing 7 surrounding the bolt 9 taking support in front of the end of the bore 3 on a further washer 12. The bolt 9 and the spacer bushing 7 thus form a force-locking connection, in which tension forces are directed through the bolt 9 and the associated compression forces through the spacer bushing 7. By this means, the position of bolt 4 is axially fixed in the outward direction. Between the rear side of bolt 4 and the washer 12 facing the bolt 4 a pack of cup springs 13 is provided, which presses the bolt 4 at all times resiliently against the screw head 8 and thus into its working position.

The bolt 4 can be pressed against the pressure of the cup springs 13 from its operating position inwards into the press stem 2 without any disadvantage owing to its slidable seating, for example if the dummy block is not centered. After removal of the un-centered dummy block, the bolt 4, which slides into a bore of the dummy block, is again pushed outwards by the spring force of the cup springs 13 until it reaches a stop in its working position.

I claim:

1. In a press stem for a metal extrusion press having a dummy block and retainer therefor, the improvement comprising a central blind bore in the end face of the press stem extending only partly through said stem, a dummy block retaining bolt slidable in said blind bore having a chamfered outer edge and a coaxial hole therethrough and a counterbore in the outer end thereof, resilient means in said blind bore for urging said bolt out of said blind bore for engagement in a bore hole in an aligned dummy block to removably support said dummy block on said end face, and adjustable means in said blind bore for retaining said bolt in said blind bore and controlling the amount the bolt projects from said end face while allowing said bolt to retract within said blind bore against the urgining of said resilient means, said adjustable means comprising a threaded bolt having an enlarged head extending through said hole and engaging a correspondingly-threaded bore in the inner end of said blind bore with said threaded bolt head situated in said counterbore, a washer between said bolt head and the shoulder between said hole and said counterbore, said bolt head and washer retaining said dummy block retaining bolt in said blind bore, and a tubular spacer of predetermined length surrounding said threaded bolt and extending between said washer and the inner end of said blind bore, said tubular spacer being interchangeable with other tubular spacers of varying lengths.

2. The press stem as claimed in claim 1 wherein said resilient urging means is a compression spring.

3. The press stem as claimed in claim 2, wherein said compression spring is a pile of cup springs.

* * * * *